US006506011B1

(12) United States Patent
Sishtla

(10) Patent No.: US 6,506,011 B1
(45) Date of Patent: Jan. 14, 2003

(54) METHOD FOR LIMITING SPLIT RING DIFFUSER TRAVEL

(75) Inventor: Vishnu M. Sishtla, Cicero, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/957,778

(22) Filed: Sep. 21, 2001

(51) Int. Cl.[7] ..... F04D 29/46
(52) U.S. Cl. ..... 415/1; 415/150
(58) Field of Search ..... 415/1, 150, 151, 415/159, 165, 166, 167

(56) References Cited

U.S. PATENT DOCUMENTS 4,611,969 A * 9/1986 Zinsmeyer ..... 415/1
5,895,204 A * 4/1999 Sishtla et al. ..... 415/148
6,129,511 A * 10/2000 Salvage et al. ..... 415/1

* cited by examiner

*Primary Examiner*—John E. Ryznic
(74) *Attorney, Agent, or Firm*—Wall Marjama & Bilinski LLP

(57) ABSTRACT

A diffuser for a centrifugal compressor includes an inner ring and an outer ring. An actuator drives a pinion gear which interfaces with a rack gear which is mounted to the inner ring. The actuator is operable to position the inner ring between a fully open position and a partially closed position with respect to the outer ring. In the fully open position, the rack gear is offset from an outer ring stop a distance equivalent to five degrees of actuator movement. The control logic of the actuator is modified so that the open position of the actuator moves the pinion gear so that the rack gear stops at or near the offset distance, leaving five degrees as the margin for error. Any overtravel by the actuator does not cause the rack gear to impact the outer ring stop, thus avoiding possible stall of the actuator.

2 Claims, 7 Drawing Sheets

METHOD FOR LIMITING SPLIT RING DIFFUSER TRAVEL

FIELD OF THE INVENTION

This invention relates generally to the field of centrifugal compressors, and more particularly to a method for limiting split ring diffuser travel.

BACKGROUND OF THE INVENTION

One of the major problems arising in the use of centrifugal vapor compressors for applications where the compressor load varies over a wide range is flow stabilization through the compressor. The compressor inlet, impeller and diffuser passages must be sized to provide for the maximum volumetric flow rate desired. When there is a low volumetric flow rate through such a compressor, the flow becomes unstable. As the volumetric flow rate is decreased from a stable range, a range of slightly unstable flow is entered. In this range, there appears to be a partial reversal of flow in the diffuser passage, creating noises and lowering the compressor efficiency. Below this range, the compressor enters what is known as surge, wherein there are periodic complete flow reversals in the diffuser passage, destroying the By efficiency of the machine and endangering the integrity of the machine elements. Since a wide range of volumetric flow rates is desirable in many compressor applications, numerous modifications have been suggested to improve flow stability at low volumetric flow rates.

Many schemes have been devised to maintain high machine efficiencies over a wide operation range. In U.S. Pat. No. 4,070,123, the entire impeller wheel configuration is varied in response to load changes in an effort to match the machine performance with the changing load demands. Adjustable diffuser flow restrictors are also described in U.S. Pat. No. 3,362,625 which serve to regulate the flow within the diffuser in an effort to improve stability at low volumetric flow rates.

A common technique for maintaining high operating efficiency over a wide flow range in a centrifugal machine is through use of the variable width diffuser in conjunction with fixed diffuser guide vanes.

U.S. Pat. Nos. 2,996,996 and 4,378,194 describe variable width vaned diffusers wherein the diffuser vanes are securely affixed, as by bolting to one of the diffuser walls. The vanes are adapted to pass through openings formed in the other wall thus permitting the geometry of the diffuser to be changed in response to changing load conditions.

Fixedly mounting the diffuser blades to one of the diffuser walls presents a number of problems particularly in regard to the manufacture, maintenance and operation of the machine. Little space is afforded for securing the vanes in the assembly. Any misalignment of the vanes will cause the vane to bind or rub against the opposite wall as it is repositioned. Similarly, if one or more vanes in the series has to be replaced in the assembly, the entire machine generally has to be taken apart in order to effect the replacement.

The efficiency of a compressor could be greatly enhanced by varying the outlet geometry of the diffuser. A variable geometry pipe diffuser is disclosed in U.S. Pat. No. 5,807, 071. A variable geometry pipe diffuser (which may also be termed a split-ring pipe diffuser) splits the diffuser into a first, inner ring and a second outer ring. The inner and outer rings have complementary inlet flow channel sections formed therein. That is, each inlet flow channel section of the inner ring has a complementary inlet flow channel section formed in the outer ring. The inner ring and outer ring are rotatable respective one another. The rings are rotated to improve efficiency for varying pressure levels between a fully open position and a partially closed position. In the partially closed position the misalignment of the exit pipes of the diffuser causes an increase in noise. Rotation of the rings past an optimum design point results in excessive noise and efficiency degradation.

The geometrical tolerances within a centrifugal compressor are small. At the same time the loads within the compressor are large and dynamic in nature. In a split ring pipe diffuser the problem of maintaining tolerances in the face of the dynamic loading becomes quite onerous. There are both axial (thrust) loads and circumferential loads on the ring pair that need to be managed. The diffuser rings must be able to rotate relative to one another and at the same time tight control over their relative position must be maintained in order to ensure proper alignment of the flow channels and the ultimate efficiency of the compressor. The cost of maintaining the necessary tolerances in a split ring diffuser is generally very high.

Another problem with split ring diffusers is premature part wear. Lubricants are generally not used within the gas flow regions of centrifugal compressors to preclude contamination of the gases. The dynamic loads imposed upon the split ring diffuser by the gas flow exiting the impeller cause wear in the components of the diffuser to be accelerated by the absence of lubricating oil.

The drive system for accurately positioning the rings relative to one another must, among other things, be rigid to avoid any fretting of components. Because of circumferential loading on the rings there is a propensity for the inner ring to oscillate relative to the outer ring which could cause compressor instability, part wear and could adversely affect efficiency. This causes several problems that need to be overcome. A drive system is needed that is capable of preventing the relative movement between the inner and outer rings. A bearing concept is also needed which would allow for the relative rotation of the two rings and also be capable of withstanding the circumferential and thrust loads while maintaining tight geometric tolerances between the rings. There is also a need to provide a positioning system that includes positive minimum and maximum stops to avoid unnecessary noise and efficiency degradation as well as simple field retrofit. In addition, there is a need for the drive and bearing systems have a long operating life and be easy to install and adjust properly. U.S. Pat. Nos. 5,895,204; 5,988,977; and 6,015,259 address these concerns.

SUMMARY OF THE INVENTION

Briefly stated, a diffuser for a centrifugal compressor includes an inner ring and an outer ring. An actuator drives a pinion gear which interfaces with a rack gear which is mounted to the inner ring. The actuator is operable to position the inner ring between a fully open position and a partially closed position with respect to the outer ring. In the fully open position, the rack gear is offset from an outer ring stop a distance equivalent to five degrees of actuator movement. The control logic of the actuator is modified so that the open position of the actuator moves the pinion gear so that the rack gear stops at or near the offset distance, leaving five degrees as the margin for error. Any overtravel by the actuator does not cause the rack gear to impact the outer ring stop, thus avoiding possible stall of the actuator.

According to an embodiment of the invention, in a centrifugal compressor having a casing and an impeller rotatably mounted therein for bringing a working fluid from an inlet to the entrance of an annular radially disposed split ring diffuser, the diffuser including an inner ring, the inner ring having a plurality of first channel sections formed therein, an outer ring, the outer ring having a plurality of second channel sections formed therein, each second channel section having a complementary first channel section; the compressor including a drive positioning mechanism for rotating the inner ring circumferentially within the outer ring between a first, fully open position wherein the complementary first and second channel sections are aligned to allow a maximum flow of fluid through the complementary channel sections, and a second, partially closed position, wherein the first and second complementary flow guide channels are misaligned to restrict flow of fluid through the complementary channel sections, wherein the drive positioning mechanism includes an actuator; a pinion axle rotationally driven by the actuator at a first end of the pinion axle; a pinion gear mounted to a second end of the pinion axle; a rack gear fixedly mounted to the inner ring extending radially outwardly from the inner ring and adapted to engage in meshing arrangement with the pinion gear; and first and second limit stops in the actuator for limiting travel of the inner ring between the first position and the second position; the method includes the steps of (a) mounting the rack gear a predetermined distance from an outer ring stop such that the first channel sections and the second channel sections are aligned in the open position; (b) moving the rack gear against the outer ring stop; (c) installing the actuator and the pinion gear so that a full open position of the actuator, represented by a first amount of control current, positions the rack gear against the outer ring stop; (d) translating the predetermined distance to degrees rotation of the actuator; (e) translating the degrees rotation of the actuator to a second amount of control current; and (f) modifying control logic which controls the actuator so that moving the actuator to bring the inner ring into the first position is accomplished by applying a third amount of control current to the actuator, wherein the third amount of control current is equal to the first amount of control current added to the second amount of control current.

DETAILED DESCRIPTION OF THE PREFERRED EMBODIMENT

Figure 1:
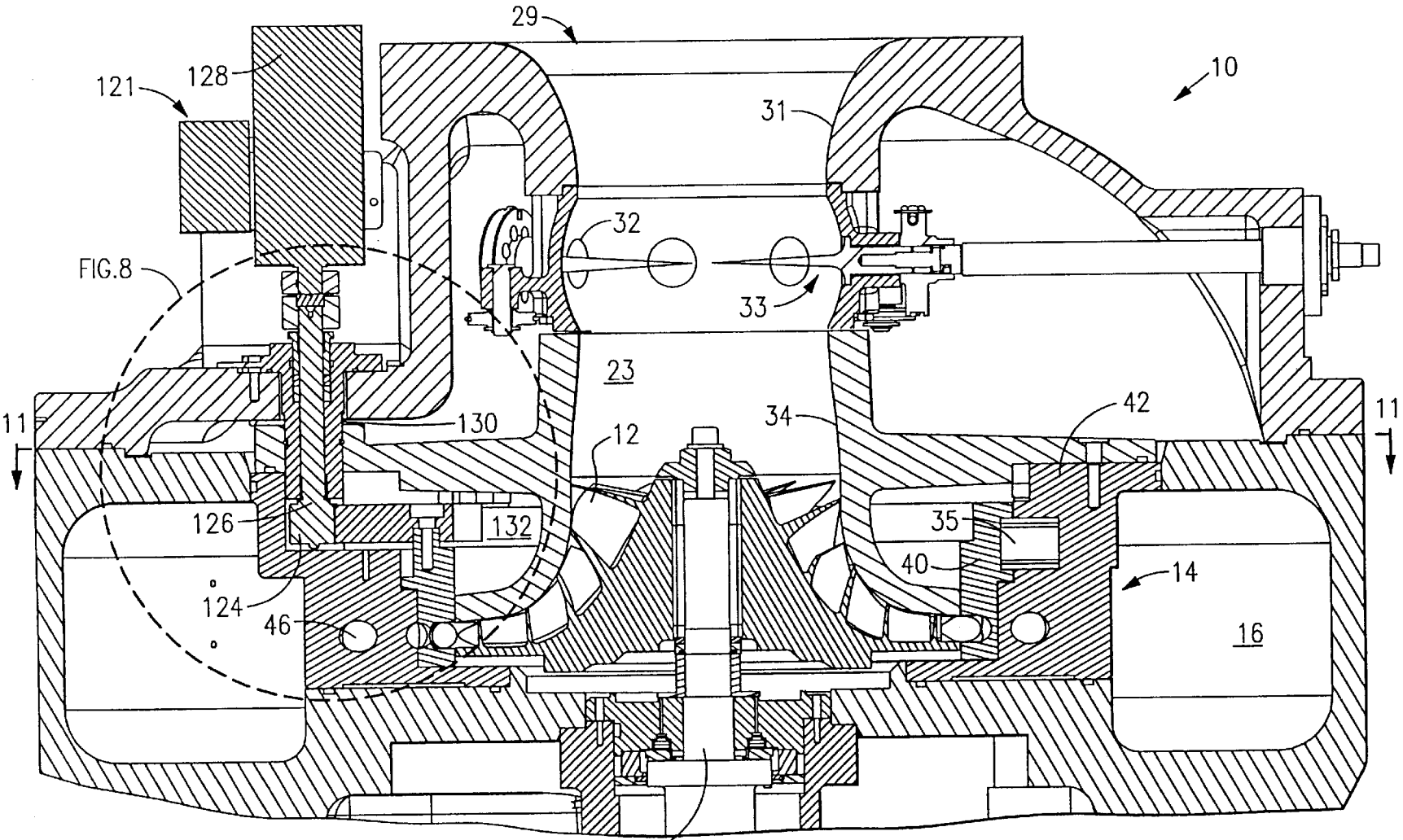
FIG. 1 shows a cross-sectional side view of a compressor according to an embodiment of the present invention.

U.S. Pat. No. 5,895,204 is incorporated herein by reference. Referring now to FIG. 1, the invention is shown as installed in a centrifugal compressor 10 as part of an HVAC system (not shown) having an impeller 12 for accelerating refrigerant vapor to a high velocity, a variable geometry pipe diffuser 14 for decelerating the refrigerant to a low velocity while converting kinetic energy to pressure energy, and a discharge plenum in the form of a collector 16 to collect the discharge vapor for subsequent flow to a condenser. Power to impeller 12 is provided by an electric motor (not shown) which is hermetically sealed in the other end of the compressor and which operates to rotate a high speed shaft 19. The refrigerant enters an inlet opening 29 of a suction housing 31, passes through a blade ring assembly 32 and a plurality of guide vanes 33, and enters a compression suction area 23 which leads to a compression area defined on its inner side by impeller 12 and on its outer side by a housing 34. After compression, the refrigerant flows into diffuser 14, collector 16, and a discharge line (not shown).

Figure 3:
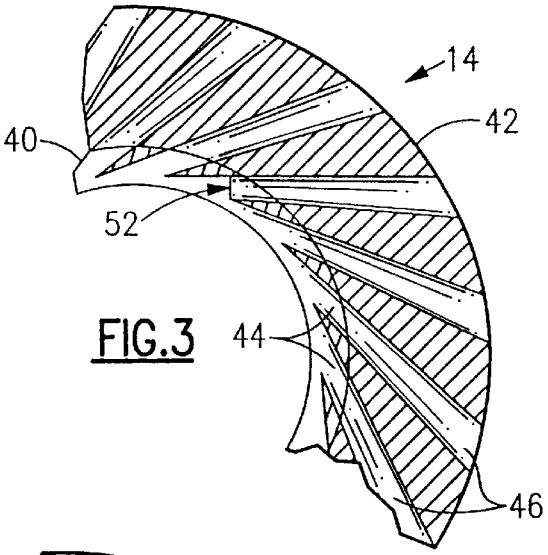
FIG. 3 shows a partial cross-sectional view of part of the variable pipe diffuser of FIG. 2 in full open position.
Figure 4:
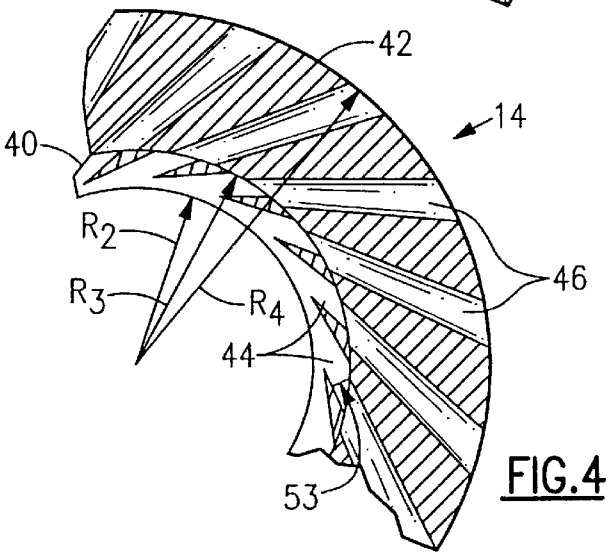
FIG. 4 shows a partial cross-sectional view of part of the variable pipe diffuser of FIG. 2 in partially closed position.
Figure 2:
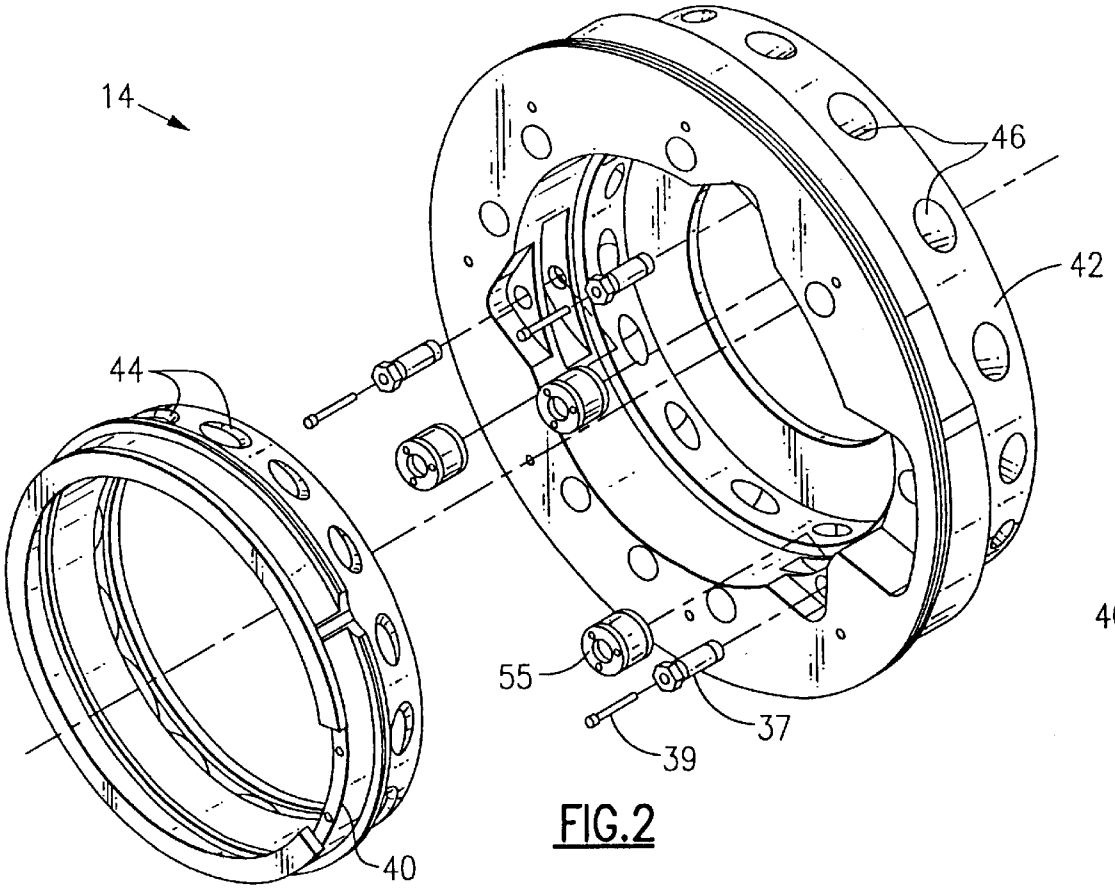
FIG. 2 shows an exploded perspective view of a variable pipe diffuser according to an embodiment of the invention.

Referring also to FIGS. 2–4, diffuser 14 includes an inner ring 40 concentrically disposed inside an outer ring 42. Inner and outer rings 40, 42 have complementary flow channel sections 44 and 46 formed therein. That is, each flow channel section 44 of inner ring 40 has a complementary channel section 46 formed in outer ring 42. Inner ring 40 and outer ring 42 are rotatable with respect to one another. In a preferred embodiment, inner ring 40 rotates circumferentially within a stationary outer ring 42.

When one ring is rotated with respect to the other, the alignment between each pair of complementary inlet flow channels of the inner and outer rings changes. Rings 40 and 42 are adjustable between a fully open position, as shown in FIG. 3, wherein complementary channel sections are aligned and a maximum amount of fluid passes through inner and outer rings 40 and 42, and a partially closed position, as shown in FIG. 4, wherein complementary channels are misaligned so that flow through channel sections 44 and 46 is restricted.

The flow of fluid (flow rate) through diffuser 14 in the partially closed position in relation to the fully open position is determined by the ratio of the minimum cross-sectional area of the flow channel of diffuser 14 in the partially closed position to the minimum cross-sectional area of the flow channel (defined by complementary channel sections 44 and 46) in the fully open position. This minimum flow channel area, known as the "throat area", is generally be determined by the smallest diameter of a flow passage 52 of inner ring channel section 44 when diffuser 14 is in a fully open position, and is controlled by a width 53 at an interface between inner and outer rings 40 and 42 when diffuser 14 is in the partially closed position. The flow rate of fluid through compressor 10 when diffuser 14 is in the partially closed position is generally between about 10% and 100% of the flow rate of the fluid through compressor 10 when diffuser 14 is in the fully open position.

In the partially closed position, at least about 10% the volume of flow as compared to the fully open position should flow through diffuser 14 so as to prevent excessive thermodynamic heating, excessive noise and degradation in the efficiency of the compressor. To this end, the amount of relative rotation between the two ring sections should be limited to an amount of rotation necessary to effect the second partially closed position. In other words, the rings should not be adjustable to completely close off the flow of fluid there between. The degree of allowable rotation between rings 40, 42 is determined by the desired flow between rings 40, 42 in the fully closed position and the number and volume of inlet flow channel sections 44, 46 in rings 40, 42 in relation to the volume of ring sections 40, 42.

$R_2$ defines the radius of the impeller tip, $R_3$ defines the outside radius of inner ring 40, and $R_4$ defines the outside radius of outer ring 42. By making the difference R3–R2, i.e., the preferred thickness of inner ring 40, no larger than is necessary to block a desired portion (e.g. 50% of flow) of flow through outer ring channel sections 46, the flow of fluid through diffuser 14 is efficiently controlled. Rotating inner ring 40 with respect to outer ring 42 reduces the diffuser throat area before any diffusion has taken place, thus preventing flow acceleration after diffusion. The smaller the inner ring thickness, the smaller the turning angles of the flow through diffuser 14 in the partially closed position. Both of the above-described effects tend to improve compressor efficiency under partial-load operating conditions.

Figure 6:
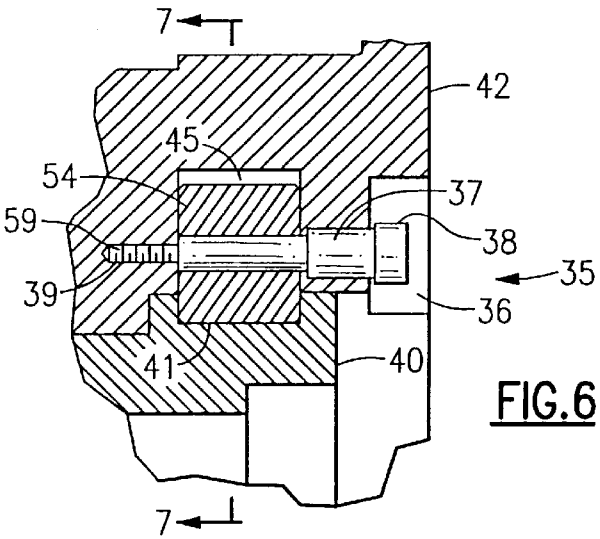
FIG. 6 shows a partial cross-sectional view of a ring support mechanism taken along the line 6—6 in FIG. 5.
Figure 7:
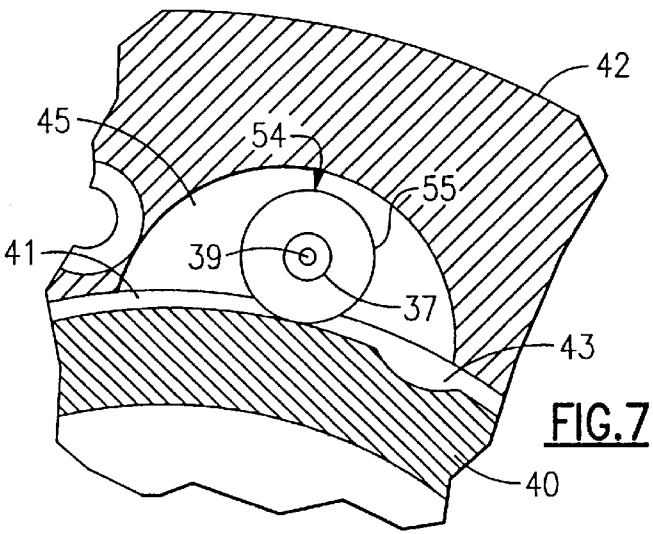
FIG. 7 shows a partial cross-sectional view of a ring support mechanism taken along the line 7—7 in FIG. 6.
Figure 5:
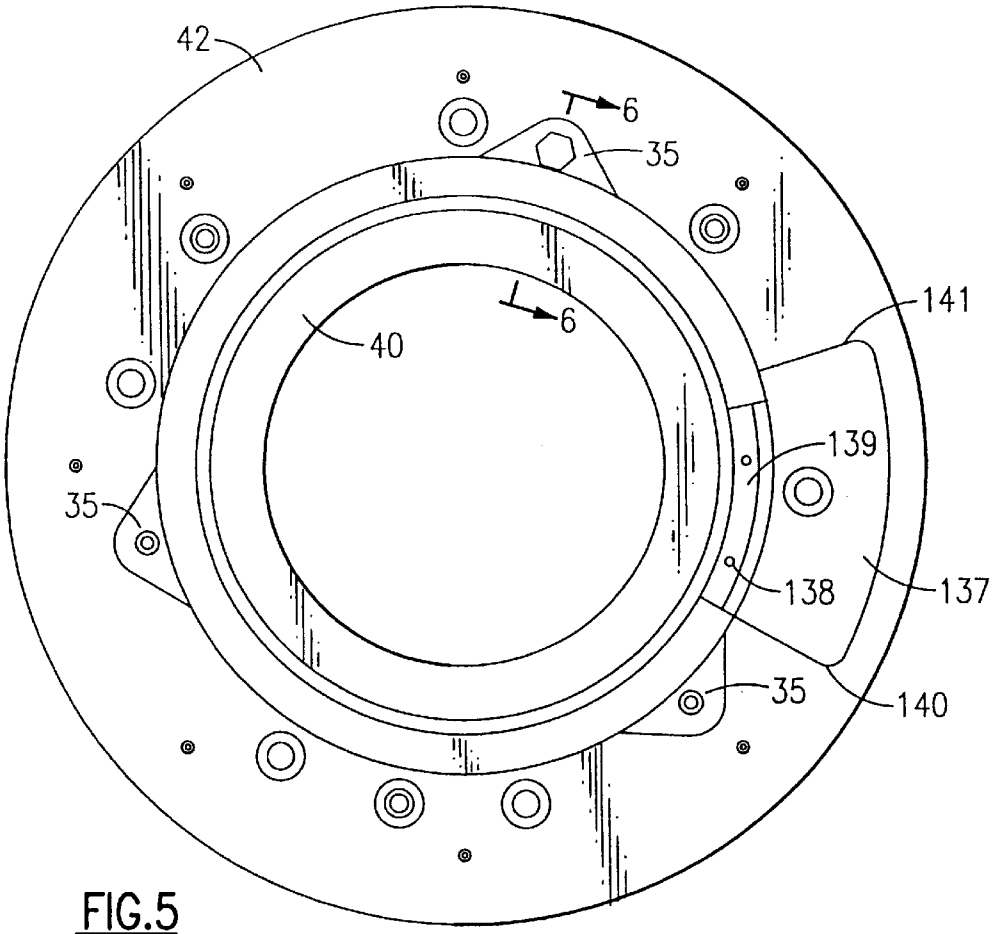
FIG. 5 shows a top view of the compressor of FIG. 1.

Referring to FIGS. 5–7, a ring support mechanism 35 according to an embodiment of the present invention is shown. The embodiment shown illustrates the use of three such mechanisms spaced circumferentially equidistant about the diffuser. Ring support mechanism 35 includes an inner bearing slot 41, a cutout 43 disposed in a surface 28 of inner ring 40, a roller assembly 54, a roller axle assembly 36, and an outer bearing slot 45 disposed in outer ring 42. Axle assembly 36 includes an axle 37 and an axle bolt 39.

Outer ring 42 is stationary with respect to suction housing 31 and three sets of ring support mechanisms 35 are preferably installed into outer ring 42 by positioning roller assembly 54 within bearing slot 45 of outer ring 42, passing axle 37 through a mounting hole 58 and roller assembly 54, and then installing axle bolt 39 through axle 37 and loosely threading axle bolt 39 into threaded holes 59 in outer ring 42. Inner ring 40 is installed inside outer ring 42 with cutouts 43 of inner ring 40 circumferentially aligned with bearing slot 45 and roller assemblies 54 before rotating inner ring 40 clockwise as shown in FIG. 7 to position roller assemblies 54 within bearing slot 41. With inner ring 40 installed within outer ring 42, ring support mechanisms 35 are employed to properly center and position the inner ring by rotating axle 37 by using a wrench (not shown) placed on hex head 38. An axle body centerline 48, on which a roller 55 of roller assembly 54 is mounted, is offset from an axle bore centerline 50. Rotating hex head 38 causes roller assembly 54 to be radially displaced relative to outer ring 42. Once inner ring 40 is properly centered within outer ring 42, hex head 38 is further rotated preferably to preload an outer bearing surface 56 of roller assemblies 54 against inner ring 40. Axle bolt 39 is then tightened. The preload conditioned is preferred because it prevents inner ring 40 from movement due to tangential and circumferential loads.

Figure 9:
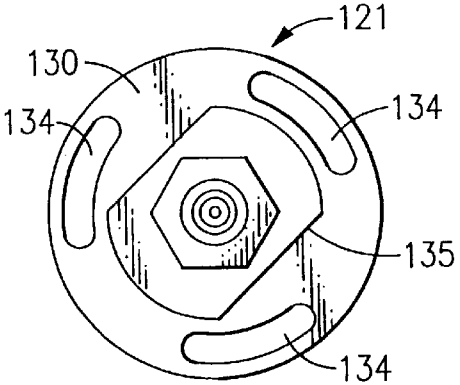
FIG. 9 shows a top view of a portion of the drive positioning mechanism of FIG. 8.
Figure 10:
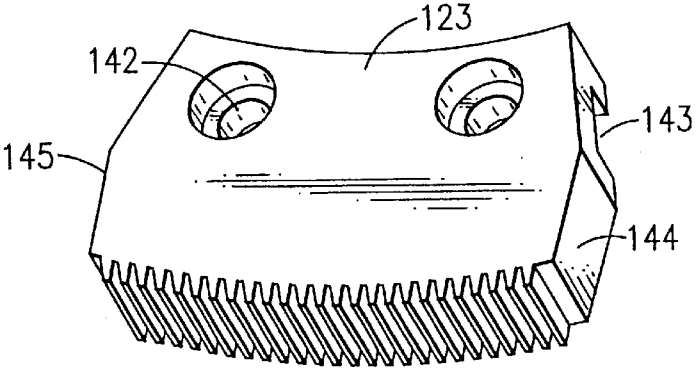
FIG. 10 shows a perspective view of a rack gear of the present invention.
Figure 8:
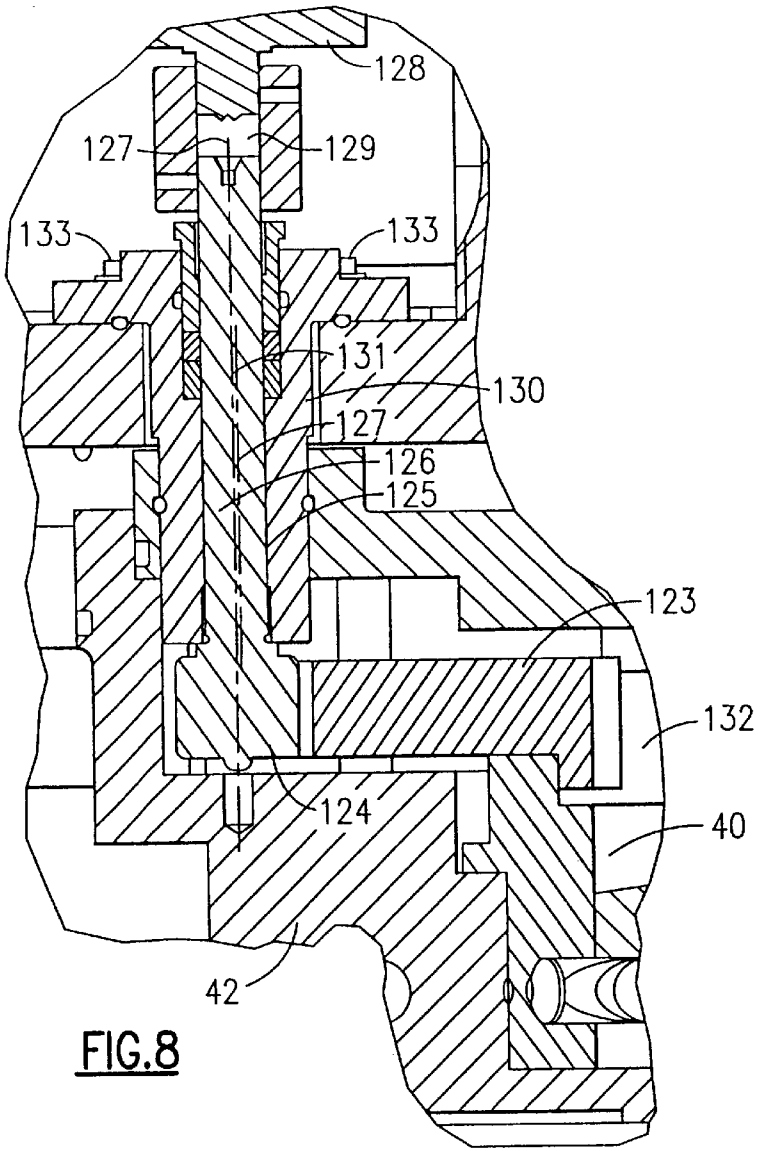
FIG. 8 shows a partial cross-sectional view of a drive positioning mechanism of the present invention.

Referring to FIGS. 8–10, a positioning drive mechanism 121 rotates inner ring 40 circumferentially within outer ring 42. A rack gear 123, which extends radially outwardly from outer ring 42, is fixedly attached to outer ring 42. Rack gear 123 includes first and second gear faces 144 and 145, respectively, as well as a plurality of mounting holes 142. A pinion gear 124 is in gearing relation with rack gear 123. Pinion gear 124 is driven via pinion axle 126 by an actuator 128. Actuator 128 is selected and controlled to effect movement of inner ring 40 in relation to outer ring 42 between the fully open position and the partially closed position and any number of intermediate positions therebetween. Pinion axle 126 is housed in a containment housing 130 which hermetically seals axle 126 from compressor interior 132 and which prevents leakage of fluid out of compressor 10 through containment housing 130.

The tangential and circumferential loading on rings 40, 42 by the refrigerant flow within diffuser 14 causes inner ring 40 to have the propensity to chatter back and forth within outer ring 42. Excess movement or chattering of inner ring 40 causes rack gear 123 and pinion gear 124 to fret and also causes other parts to wear. Preloading inner ring 40 via roller assemblies 54 as discussed earlier prevents movement of inner ring 40 as well as chattering under normal operating conditions. In cases of abnormal conditions, such as operating in a surge, a secondary mechanism is needed to prevent unwanted motion of inner ring 40. A drive mounting system prohibits adverse movement and chattering of inner ring 40 via adjustment of the relative center positions of pinion gear 124 and rack gear 123 utilizing axle containment housing 130. The axle housing outer surface 125 is concentric about housing centerline 127 while housing bore 129 is concentric about housing bore centerline 131. In one embodiment, housing centerline 127 and housing bore centerline 129 are offset by 0.060 inches. Wrench flats 135 and adjustment slots 134 of the positioning drive mechanism are shown in FIG. 9. After installation of positioning drive mechanism 121 into suction housing 31, the backlash between rack gear 123 and pinion gear 124 is removed by rotating positioning drive mechanism 121 by placing a wrench (not shown) across wrench flats 135. Once minimal backlash is achieved, positioning drive mechanism 121 is fixed in place by the tightening of cap screws 133. Once the backlash is eliminated, the tendency for inner ring 40 to move is discharged directly by actuator 128 through the gear system.

Referring also to FIG. 5, an embodiment is shown having a mechanism to provide positive positioning of inner ring 40 corresponding to the fully open position and the partially closed position. A cavity 137 is machined in outer ring 42 to accommodate rack gear 123. Rack gear 123 is accurately mounted to inner ring 40 in a tongue and groove fashion wherein rack gear 123 is provided with a circumferential groove 143 adapted to receive a tongue section 139 of inner ring 40. To determine the fully open position, inner ring 40 is positioned within outer ring 42, after which rings 40, 42 are rotated relative to one another until flow passages 52 are fully aligned with outer flow channels 46. With rings 40, 42 in this position, and with ring support mechanisms 35 adjusted as described above, rack gear 123 is mounted to inner ring 40 with second gear face 145 in contact with fall open stop 140 of cavity 137. Bolts 152 (FIG. 11) are then installed through gear mounting holes 142 and securely tightened into threaded holes 138 in inner ring 40. Rack gear 123 and cavity 137 are sized to provide for a predetermined amount of closure of the pipe diffuser. For example, an embodiment is sized such that difference between the rack gear angular width and the cavity provide for a 10% open position. In this example, the required travel of rack gear 123 is 10 degrees, the rack gear angular width is 35 degrees, and the corresponding cavity angular width is 45 degrees. With rack gear 123 so positioned, a positive stop is created between rack gear 123 and cavity 137 to accurately and repeatably position rings 40, 42 at points corresponding to the fully open position and the partially closed position. The positive stops also allow for field retrofit of actuator 128 without the need to readjust the position of inner and outer rings 40, 42.

Figure 12:
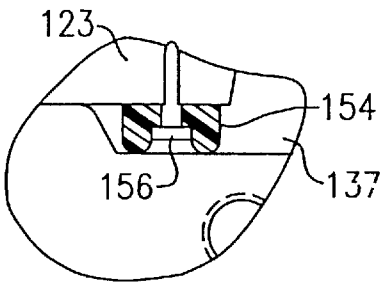
FIG. 12 shows an expanded view of a mechanical stop according to an embodiment of the present invention.
Figure 11:
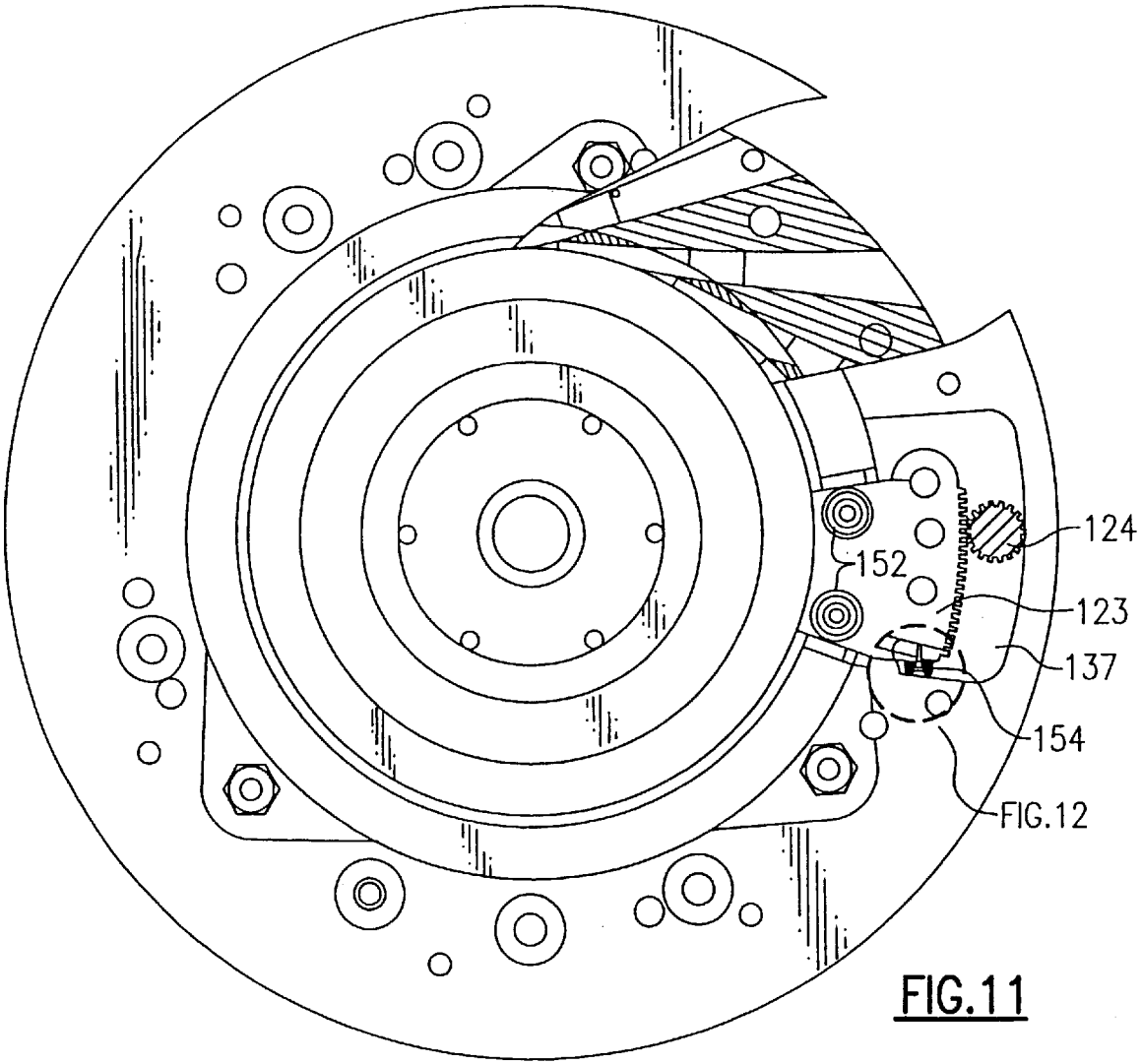
FIG. 11 shows a partial sectional view of the compressor of the present invention.

Referring to FIGS. 11–12, a mechanical stop 154 is affixed to rack gear 123 by a fastener such as a bolt 156. Mechanical stop 154 is preferably of a deformable or compliant material so that actuator 128 (FIG. 8) does not stall, thereby avoiding actuator failure. Preferable materials for mechanical stop 154 include Teflon® and ultra high molecular weight (UHMW) plastic.

Referring back to FIGS. 3, 4, 8, and 11, actuator 128 includes first and second electrical limit switches to control total travel. The position of rack gear 123 in inner ring 40 is adjusted so that when inner ring channel sections 44 and outer ring channel sections 46 are collinear, mechanical stop 154 on rack gear 123 is against outer ring stop 140. In this position, actuator 128 is against one the first limit switch. During the course of operation, it is possible for rack gear 123 to touch outer ring 42 before actuator 128 hits the first limit switch. In this mode, actuator 128 drives rack gear 123 a few more degrees before hitting the first limit switch. Without mechanical stop 154, because actuator 128 puts out very high torque, known as stall torque, the gear teeth in the actuator drive train break. The compliant, deformable material in mechanical stop 154 between rack gear 123 and outer ring 42 limits the actuator torque output, thereby protecting the gear teeth.

In another embodiment of the invention, a control algorithm for actuator 128 is modified to prevent possible stall of actuator 128. When rack gear 123 is mounted onto inner ring 40, a mechanical stop is not used. Instead, a shim is placed between rack gear 123 and outer ring stop 140. The width of the shim depends on the actuator being used. Generally, actuators and pinion gears used for this purpose have a range of motion between 120–160 degrees. The preferred standoff distance to protect actuator 128 against actuator stall is about 5 degrees, which equates to a distance of 0.06". Therefore, a shim that is 0.06 inches wide would be used. With the shim in place against outer ring stop 140, the position of rack gear 123 on inner ring 40 is adjusted so that, when inner ring channel sections 44 and outer ring channel sections 46 are collinear, the side of rack gear 123 is against the shim. After bolting rack gear 123 in position, the shim is removed. In this configuration, pinion gear 124 rotates approximately 5 degrees before the side of rack gear 123 touches outer ring stop 140.

When actuator 128 and pinion gear 124 are installed, rack gear 123 is moved against outer ring stop 140 to provide an absolute position for actuator 128. The control current for these actuators is typically from 4 to 20 mA DC, with 4 mA being the open actuator position. Actuator 128 is installed with the 4 mA position holding rack gear 123 against outer ring stop 140. However, we want the control logic to move rack gear 123 only to the open channel position (which was set with the shim in place) instead of past the open channel position to outer ring stop 140. If the total range of motion for actuator 128 is 130 degrees, then the control current approximately equivalent to 5 degrees of motion is 0.6 mA. In this example, the range of current is from 4 mA to 20 mA, or 16 mA. 16 mA/130 degrees times 5 degrees equals 0.6 mA. Therefore, the control logic must be changed so that 4.6 mA is used to drive actuator 128 instead of using 4 mA. Rack gear 123 will thus reach the full open position for the channels with some margin for error, and thus avoid actuator stall.

Figure 13:
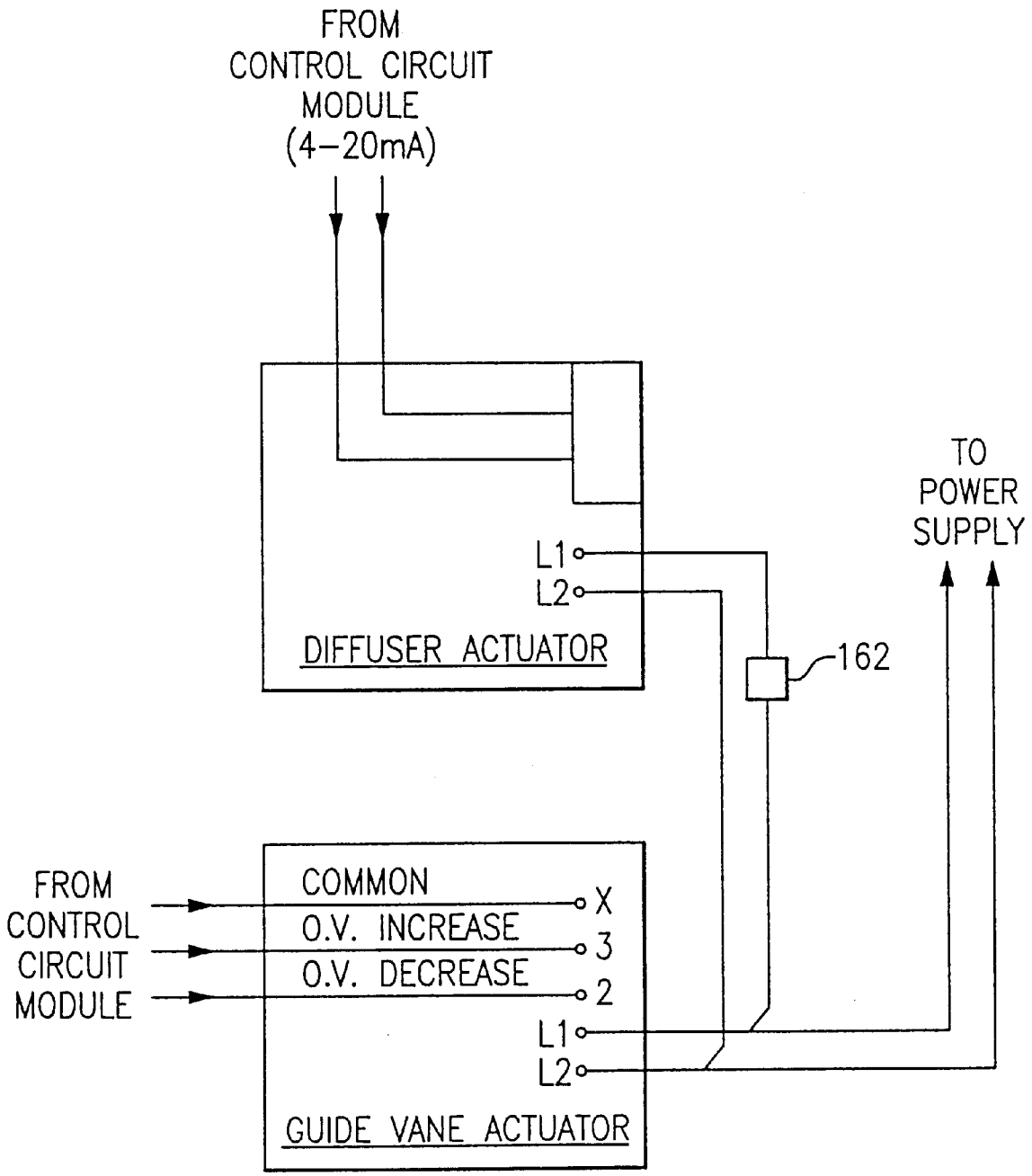
FIG. 13 shows a partial schematic of control circuitry for the drive positioning mechanism.
Figure 14:
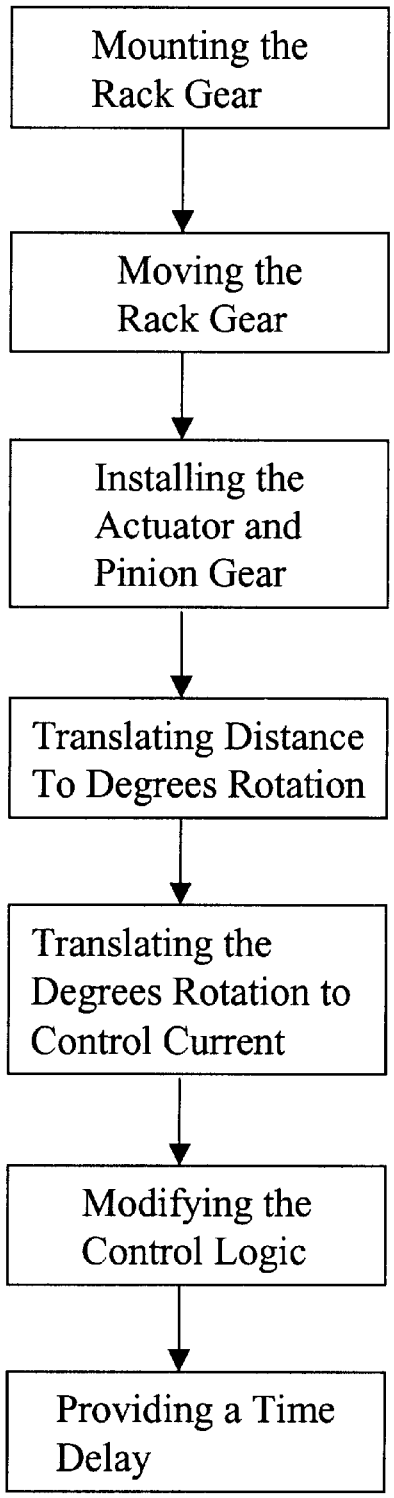
FIG. 14 shows a flow chart of the process steps of the present invention.

Another problem can arise in the event of a power failure while the compressor is running. Rack gear 123 and pinion gear 124 maintain the position they are in when the power fails, but upon power restoration, actuator 128 moves to its full open position, 4 mA in this example. As described above, this position coincides with outer ring stop 140. Since the control logic takes about 25 to 30 seconds for initialization, there is nothing to stop actuator 128 from moving to its 4 mA position, thus potentially causing actuator stall. The preferred solution is to install a time delay relay 162 in the actuator power circuit as shown in FIG. 13. Time delay relays typically come in steps, so any time delay relay with a step equal to 35 seconds or more works to delay the movement of actuator 128 long enough for the control logic to initialize and move actuator 128 to the 4.6 mA position instead of the 4 mA position.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. In a centrifugal compressor having a casing and an impeller rotatably mounted therein for bringing a working fluid from an inlet to the entrance of an annular radially disposed split ring diffuser, said diffuser including an inner ring, said inner ring having a plurality of first channel sections formed therein, an outer ring, said outer ring having a plurality of second channel sections formed therein, each second channel section having a complementary first channel section; said compressor including a drive positioning mechanism for rotating said inner ring circumferentially within said outer ring between a first, fully open position wherein said complementary first and second channel sections are aligned to allow a maximum flow of fluid through said complementary channel sections, and a second, partially closed position, wherein said first and second complementary flow guide channels are misaligned to restrict flow of fluid through said complementary channel sections, wherein the drive positioning mechanism includes an actuator; a pinion axle rotationally driven by said actuator at a first end of said pinion axle; a pinion gear mounted to a second end of said pinion axle; a rack gear fixedly mounted to said inner ring extending radially outwardly from said inner ring and adapted to engage in meshing arrangement with said pinion gear; and first and second limit stops in said actuator for limiting travel of said inner ring between said first position and said second position; the method comprising the steps of:

mounting said rack gear a predetermined distance from an outer ring stop such that said first channel sections and said second channel sections are aligned in the open position;

moving said rack gear against said outer ring stop;

installing said actuator and said pinion gear so that a full open position of said actuator, represented by a first amount of control current, positions said rack gear against said outer ring stop;

translating said predetermined distance to degrees rotation of said actuator;

translating said degrees rotation of said actuator to a second amount of control current; and modifying control logic which controls said actuator so that moving said actuator to bring said inner ring into said first position is accomplished by applying a third amount of control current to said actuator, wherein said third amount of control current is equal to said first amount of control current added to said second amount of control current.

2. A method according to claim 1, further comprising the step of providing a time delay relay in a power circuit of said actuator, wherein said time delay relay delays a powering on of said actuator for a period of time sufficient for said control logic to become activated before said actuator is powered on.

* * * * *